US005238106A

United States Patent [19]

Nguyen et al.

[11] Patent Number: 5,238,106

[45] Date of Patent: Aug. 24, 1993

[54] KITCHEN-SINK ORGANIZER

[76] Inventors: Tung D. Nguyen; Melody R. Nguyen, both of 9012 Pioneer Dr., Huntington Beach, Calif. 92646

[21] Appl. No.: 959,415

[22] Filed: Oct. 13, 1992

[51] Int. Cl.[5] ..... B65D 43/16

[52] U.S. Cl. ..... 206/223; 206/362.1; 220/337; 248/206.3; 248/311.2; 312/207

[58] Field of Search ..... 206/223, 229, 361, 362, 206/362.1, 362.2, 362.3, 15.2, 15.3; 220/337, 571, 572, 601, 636; 248/206.3, 311.2; 312/206, 207

[56] References Cited

U.S. PATENT DOCUMENTS

| | | | |
|---|---|---|---|
| 3,085,678 | 4/1963 | Moore | 206/361 |
| 3,229,844 | 1/1966 | Simon | 248/311.2 |
| 4,029,234 | 6/1977 | Johnson, Jr. et al. | 220/337 |
| 4,416,372 | 11/1983 | Polk | 206/362 |
| 4,611,716 | 9/1986 | Sorlien | 248/206.3 |
| 4,638,910 | 1/1987 | Bokmiller | 206/361 |

FOREIGN PATENT DOCUMENTS

| | | | |
|---|---|---|---|
| 0545329 | 1/1953 | Canada | 206/361 |
| 0611145 | 5/1979 | Switzerland | 206/15.2 |
| 0623839 | 5/1949 | United Kingdom | 220/571 |

OTHER PUBLICATIONS

Butler-Suburbanite Industries; Author: Unknown; Title: "Scrubs"; Date: Unknown.

Inomata-Ik; Author: Unknown; Title: Clean Home Mae; Date: Unknown.

Sinka-Days; Author: Unknown; Title: Unknown; Date-:Unknown.

*Primary Examiner*—Jimmy G. Foster

[57] ABSTRACT

The organizer consists of two main parts, a base and a lid. The base is sectioned into compartments by a divider. One compartment is used for storing sponges, and the other is used for storing sponges or cleaning tools with handle or combination of both. The slots on the sides of the base accommodate those tools with handle. There are drainage holes on the bottom of the base which allow liquid to drain out. There are also suction cups on the outside of the bottom of the base to keep it in place. The lid of the organizer, when opened, serves as a reservoir to hold washing solution. When closed, the lid hides the unsightly cleaning tools.

6 Claims, 3 Drawing Sheets

KITCHEN-SINK ORGANIZER

BACKGROUND OF THE INVENTION

1. Field of the Invention

The subject invention generally pertains to organizers for tools, and more specifically to an organizer for cleaning tools for sinks.

2. Description of Related Art

Related invention have been seen in the market. Those inventions consist of a long base and a handle in the middle. The long base has two equal-sized compartments. Cleaning tools are to be stored in the two compartments.

There are several disadvantages in those inventions. For one the long shape is too bulky for the sink. Another disadvantage is that the compartments do not accommodate storage for long tools such a brushes. Another disadvantage is that those inventions do not provide any lid to hide the more-often-than not unsightly tools right at the sink.

Other methods of storing cleaning tools involve the use of any unconventional, empty containers of food. Used containers of food, however, can cut users and induce health hazard. There are also sponge and soap trays that do not have any cover, mean of drainage, or space for brushes.

SUMMARY OF THE INVENTION

To avoid the limitations and problems with present methods of storing sink-cleaning tools, it is an object of the subject invention to provide an organizer that enables user to store all sink-cleaning tools in a convenient and sanitary manner.

Another object is to replace the cumbersome structure of earlier inventions with a neat structure.

Another object is to provide a organizer having slots to accommodate cleaning tools with handle.

Another object is to facilitate the washing at the sink by providing a lid that can be used as a temporary detergent container.

Another object is to conserve water while washing.

Another feature of the invention is the inclusion of suction cups to keep the organizer rigid in one place.

These and other objects of the invention are provided by a sink organizer that has a base pivotly connected to a lid. The base has two compartments, one for storing sponges and other small cleaning tools, and one for storing larger cleaning tools, including ones with handle. There are also suction cups on the base to keep the organizer stationary.

DESCRIPTION OF THE PREFERRED EMBODIMENT

Figure 1:
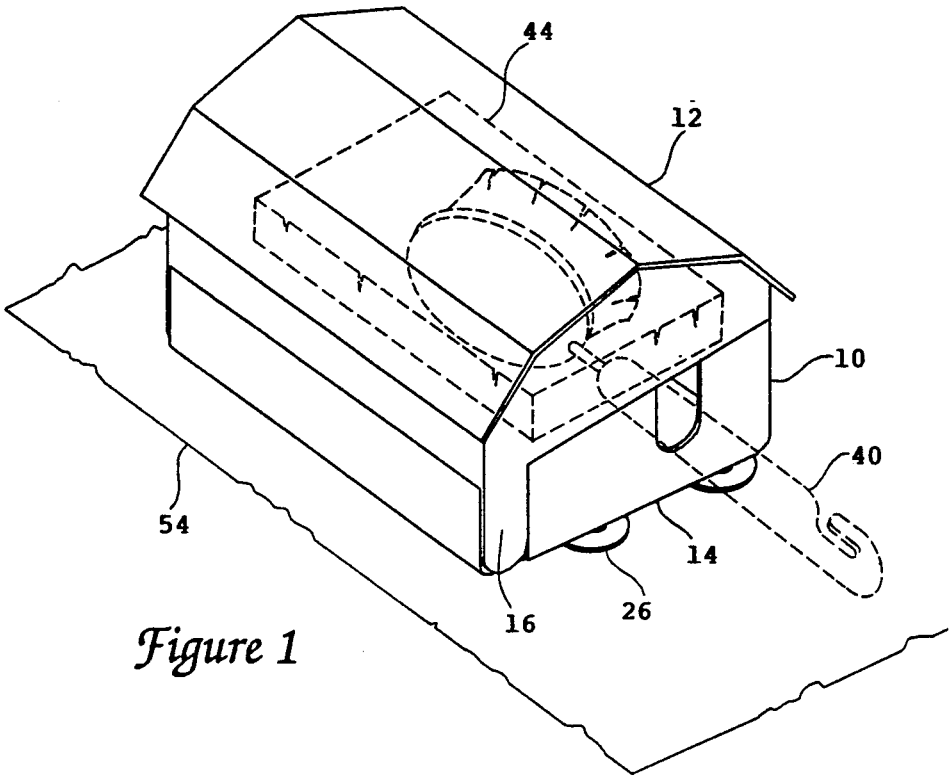
FIG. 1: is a perspective view of the Kitchen-Sink Organizer of the present invention in closed position.

Referring to FIG. 1, an organizer 10 for storing various cleaning tools such as brush 40, sponge 44, etc. . . . with a base 14, a lid 12, and suction cups 26 for holding the organizer 10 onto a surface 54. The lid 12 is attached to the base 14 at pivotly swing arms 16.

Figure 2:
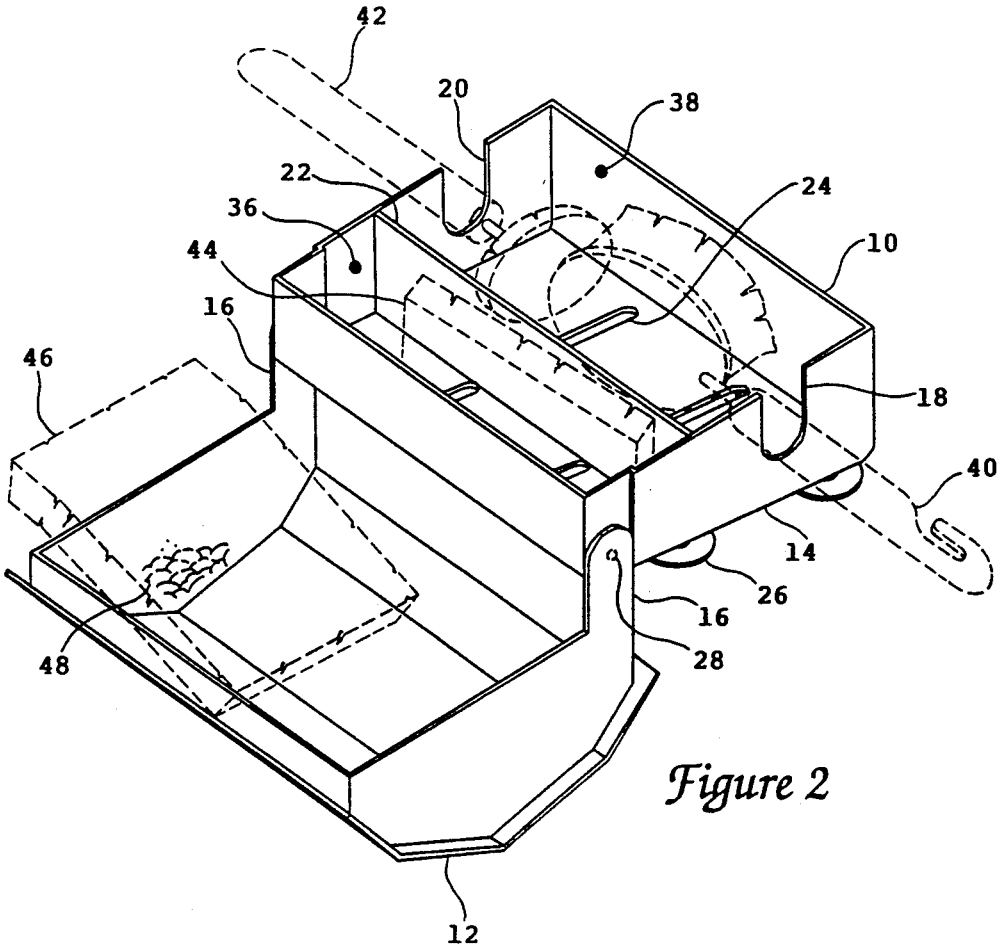
FIG. 2: is a perspective view of the Kitchen-Sink Organizer of the present invention in opened position.

Referring to FIG. 2, the base 14 is divided into two compartments, front compartment 38 and back compartment 36, by a divider 22. The divider 22 is removable. The right slot 18 is on the right wall of the organizer 10, and the left slot 20 is on the left wall of the organizer 10. There are drainage holes 24 on the bottom of the base 14. Pivotly swing arms 16 are used to attach the lid 12 to the base 14 at pivot points 28.

In use, the organizer 10 provides many functions. Front compartment 38 can hold a brush 40 with its handle resting out on the right slot 18. Another brush 42 can also be stored in the front compartment 38 with its handle resting out on the left slot 20. Sponges 44 can be stored in the back compartment 36. Sponges 44 can also be stored in the front compartment 38. When opened, the lid 12 is a reservoir for holding washing solution 48 and the in-use sponge 46. The organizer 10 is a hide-away place for cleaning utensils when the lid 12 is closed (FIG. 1).

Figure 3:
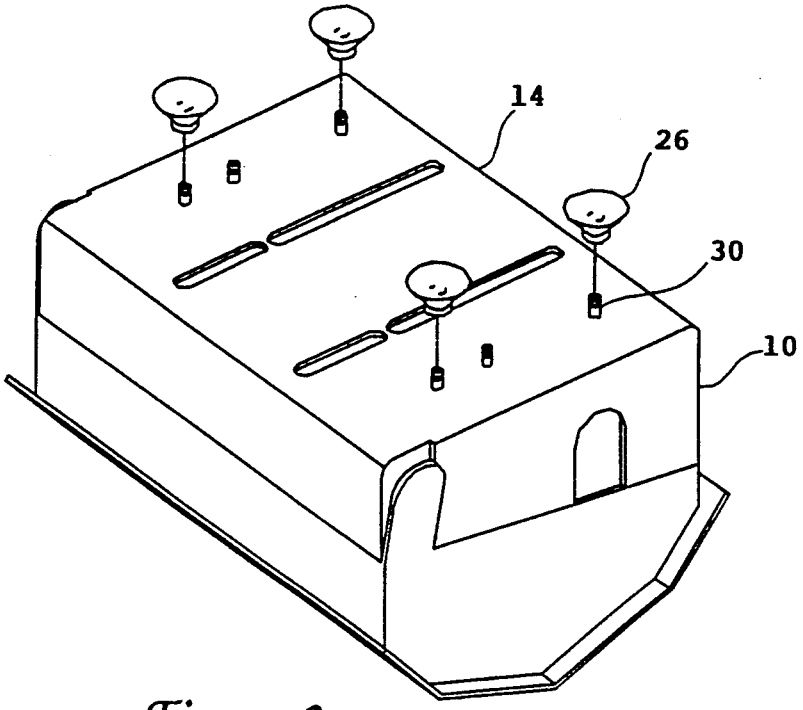
FIG. 3: is an upside-down view of the Kitchen-Sink Organizer shown in FIG. 1 and FIG. 2 with suction cups being assembled.

Referring to FIG. 3, there are posts 30 on the out side of the base 14 for inserting suction cups 26. Suction cups 26 will hold the organizer 10 stationary.

Figure 4:
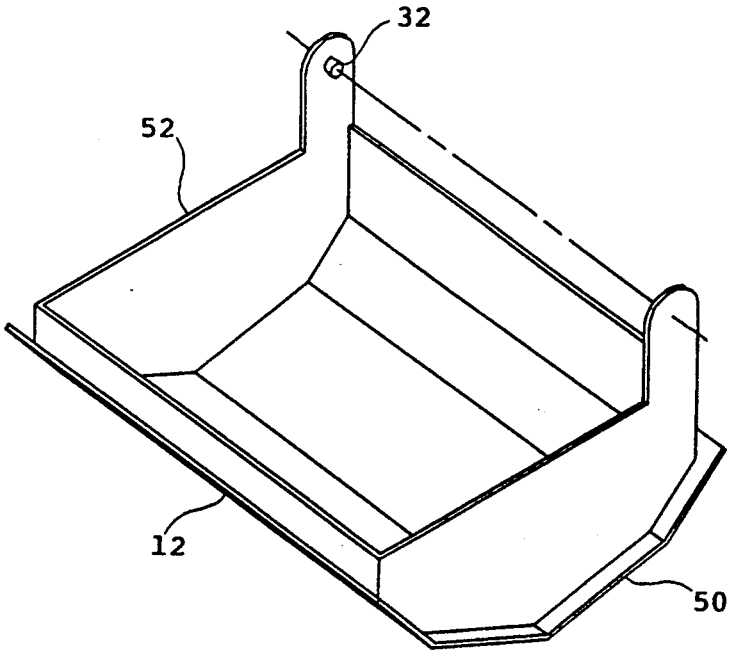
FIG. 4: is a perspective view of the lid of the Kitchen-Sink Organizer.
Figure 5:
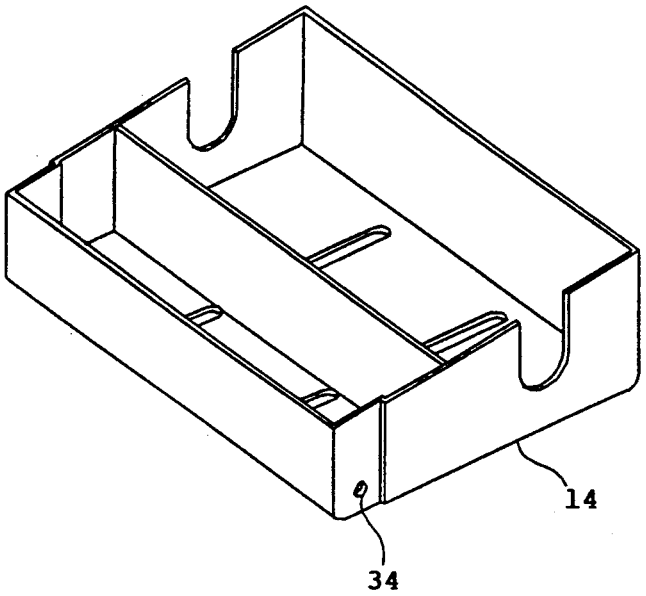
FIG. 5: is a perspective view of the base of the Kitchen-Sink Organizer.

Referring to FIG. 4, the lid 12 has a roof 50 extending out from all four sides of frame 52 for easy opening and closing. A node 32 serves as a joint to fit in the socket 34 in FIG. 5.

Figure 6:
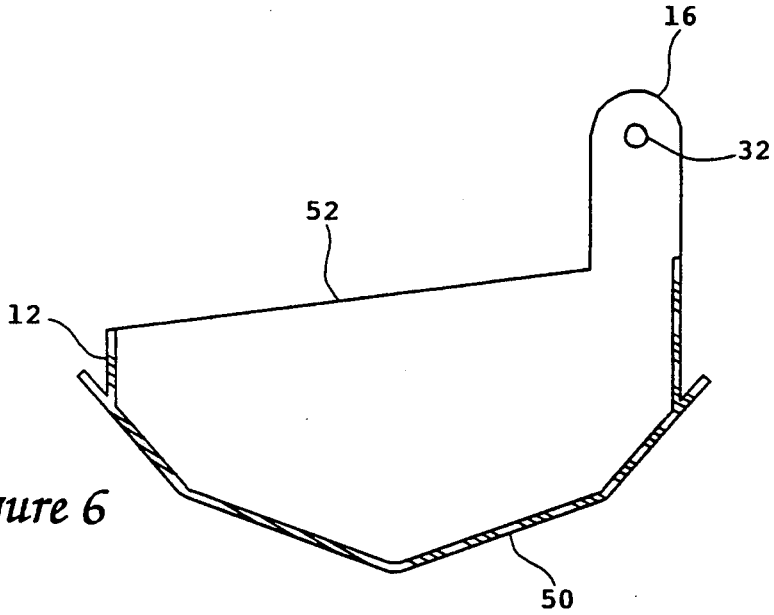
FIG. 6: is a section-cut view of the Kitchen-Sink Organizer's lid.

FIG. 6 shows a section-cut view of the lid 12 with a roof 50 and its extension, a node 32, a pivotly swing arm 16, and a frame 52.

Figure 7:
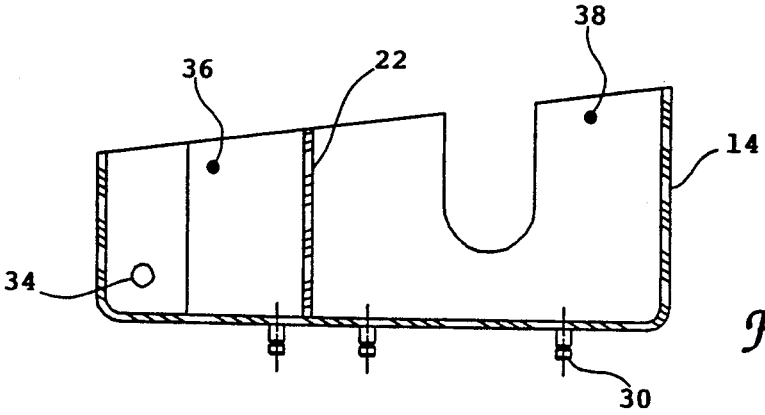
FIG. 7: is a section-cut view of the Kitchen-Sink Organizer's base.

FIG. 7 shows a section-cut view of the base 14 with the front compartment 38, the back compartment 36, the divider 22, the socket 34, and the posts 30.

Although the invention is described with respect to a preferred embodiment, modifications thereto will be apparent to those skilled in the art. Therefore, the scope of the invention is to be determined by reference to the claims which follow:

We claim:

1. An organizer used for storing cleaning tools, comprising:

a base having sides and a bottom, said bottom having an outside surface;

a divider in said base;

a slot on the sides of said base;

at least one drainage hole on the bottom of said base;

at least one post on the outside surface of the bottom of said base;

at least one suction cup adapted to be assembled to a respective post on said base;

a lid; and pivotly swing arms adapted for attaching said lid to said base.

2. The organizer as recited in claim 1, wherein said divider is adapted to be removed from said base.

3. The organizer as recited in claim 1, wherein said divider separates said base into compartments.

4. The organizer as recited in claim 1, wherein said at least one drainage hole includes a plurality of drainage holes.

5. The organizer as recited in claim 1, wherein said at least one post includes a plurality of posts.

6. The organizer as recited in claim 1, wherein said at least one suction cup includes a plurality of suction cups.

* * * * *